United States Patent [19]

Kiowski et al.

[11] 4,316,702

[45] Feb. 23, 1982

[54] OIL WELL CONTROL CIRCUIT

[75] Inventors: John W. Kiowski, Denton; John V. Rolando, Dallas, both of Tex.

[73] Assignee: Electronic Systems Division, Geosource, Inc., Houston, Tex.

[21] Appl. No.: 130,977

[22] Filed: Mar. 17, 1980

[51] Int. Cl.[3] ..... F04B 49/00

[52] U.S. Cl. ..... 417/12

[58] Field of Search ..... 417/12, 63, 44, 45; 60/403

[56] References Cited

U.S. PATENT DOCUMENTS

| | | | |
|---|---|---|---|
| 2,596,330 | 5/1952 | Everard . | |
| 2,707,440 | 5/1955 | Long et al. | 417/12 |
| 3,936,231 | 2/1976 | Douglas | 417/12 |
| 3,953,777 | 4/1976 | McKeo . | |

*Primary Examiner*—Carlton R. Croyle
*Assistant Examiner*—Edward Look
*Attorney, Agent, or Firm*—Hubbard, Thurman, Turner, Tucker & Glaser

[57] ABSTRACT

An improved oil well pump timer including means for detecting periods of power outage and providing a pumping period following the outage of sufficient length to maintain an essentially constant duty cycle. Clock controlled timers determine preselected on and off cycle periods. Power failure detecting circuitry inhibits on timer operation and counts the number of off time cycles occurring during the outage. Upon reestablishment of power, control circuitry inhibits the off timer and provides a number of on time cycles equal to the number of off cycles during the outage.

10 Claims, 3 Drawing Figures

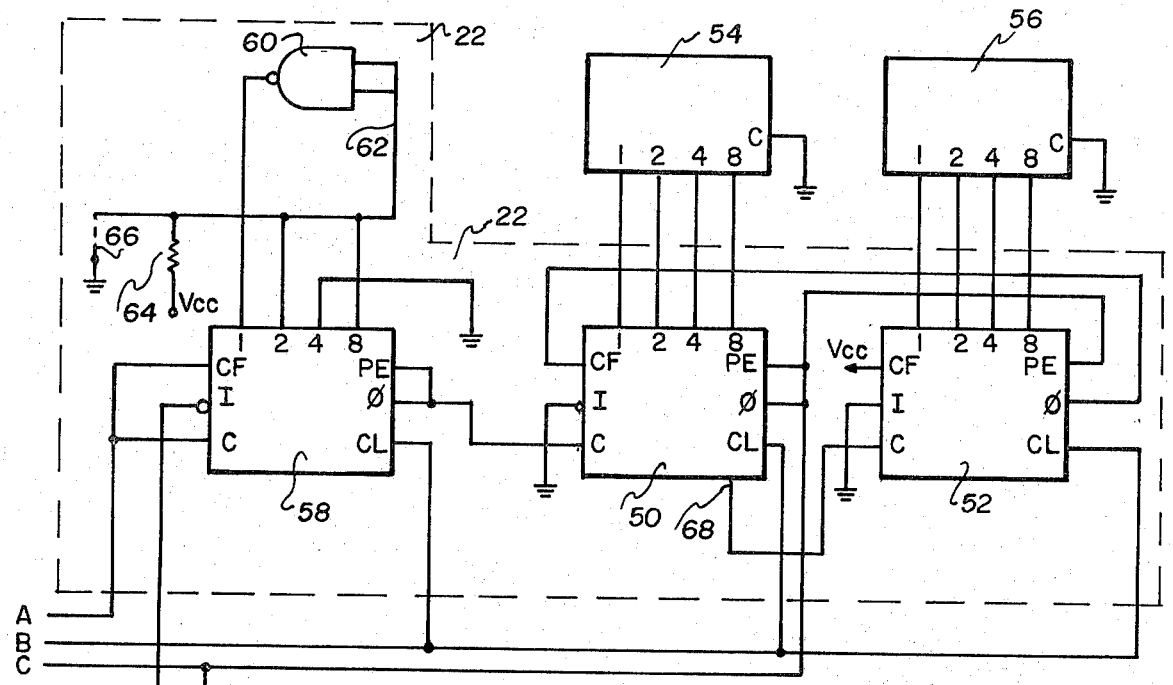
FIG. 3
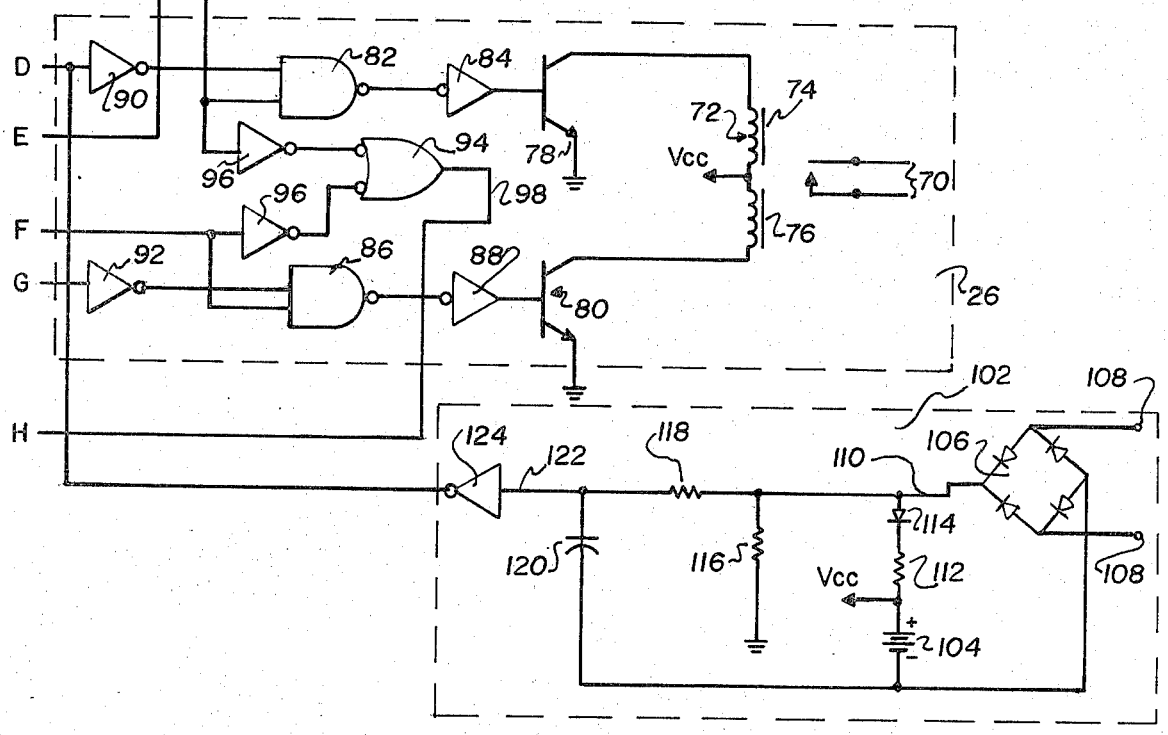

OIL WELL CONTROL CIRCUIT

BACKGROUND OF THE INVENTION

The present invention relates oil well pump timer controls and more particularly to an oil well pump control which maintains a substantially constant on-off duty cycle when intermittent power outages prevent pump operation.

Prior art known to the applicant and believed to be relevant to the present invention includes U.S. Pat. No. 2,596,330 issued to Everard on May 13, 1952 and U.S. Pat. No. 3,953,777 issued to McKee on Apr. 27, 1976. The Everard patent discloses an electromechanical clock mechanism for duty cycle control of an oil well pump. The McKee patent on the other hand discloses current sensing apparatus for shutting off an oil well pump when a pumped off condition occurs as indicated by reduced motor currents.

Most oil wells require artificial lift equipment for the production of oil. Most artificial lift equipment comprises some type of electrically powered pump for lifting the oil from the bottom of the well bore to the surface tanks. The quantity of production from a well is determined almost totally by the natural conditions of flow of oil from the formation into the well bore. Ideally a well pump is sized to pump the oil from the well bore at the natural flow rate. But, since every well is somewhat different and every well's production changes with time, it has not proven practical to provide a pump having the exact production capability as the well. It is not desireable to have an undersized pump since this allows a head of oil to build up in the well bore and reduces the production rate. On the other hand an oversized pump will eventually pump the well bore dry and continued operation of the pump will damage the pump itself.

Various types of pump off controls have been provided for shutting down an oil well pump to prevent damage when the bore has been pumped dry. Some of these control devices detect fluid flow while others detect the motor current as taught in the above referenced McKee patent. The simplest and oldest form of well pump controller is the on-off duty cycle controller such as the timed switch taught by the above referenced Everard patent.

The on-off timer is still the most universally accepted well pump controller for several reasons. Control by time periods is easy to understand and the controllers are usually relatively inexpensive and easy to install and operate. Operators therefore can appreciate the commercial advantages of such devices and once having installed a time controller are unlikely to discard it in favor of a more expensive type of control system. But in practice several problems have arisen with the use of such on-off timers. Some of the timers are actually more complicated than required by allowing the setting of nonuniform on periods and nonuniform off periods. Maximum efficiency is actually acheived by providing on periods of sufficient length to pump the fluid down to pump inlet level and off periods of sufficient length to allow the well bore to refill. Such on and off periods may vary slowly but are essentially constant on a day-to-day basis. As a result the controller having a single presettable on time and single presettable off time is actually preferable to a controller allowing nonuniform times to be set during a twenty-four hour or seven day period.

A second and more serious problem occurs when a power outage shuts down the well during time periods when the well should be pumping. Stripper wells are often located in remote areas and are not provided with a reliable source of electrical power. An operator can determine in various ways that power has been turned off to his well he visits the well for inspection or removal of stored oil. Most electromechanical timing devices include a time indicator and when the indicated time is incorrect the operator knows that the power has been off. In response to such a condition operators often manually overrid the timing device and turn the well on continuously for a longer period of time than is desireable. For example the operator may turn the pump on and leave it on continuously until the next inspection trip. Such an operation almost insures a well will pump dry and some damage will be done to the pump. It can be seen that it would be desirable to turn the pump on continuously after a power outage for only a sufficient time to pump the well bore down to pump inlet level and then to shut the pump off for the normal off time.

SUMMARY OF THE INVENTION

Accordingly it is an object of the present invention to provide an improved oil well pump time controller for maintaining an approximately constant on-off duty cycle in spite of power outages.

Another object of the present invention is to provide an oil well pump timer having presettable on and off pump time periods and means for extending an on time period in proportion to the length of pump off time occuring as a result of power outages.

These and other objects of the present invention are achieved by providing an oil well pump control system having presettable timers for controlling on time and off time of the pump, means for detecting power outages, means for storing an indication of pump off time caused by a power outage, and means for providing a long pump on time period following reestablishment of pump power as a function of the off time of the pump occuring during the power outage. In a preferred form, off time of the pump occuring during a power outage is determined by the number of preset off time cycles which occur within the power outage period and pump on time following reestablishment of power is determined as a number of preset on time periods equaling the number of off time periods counted during the power outage.

BRIEF DESCRIPTION OF THE DRAWINGS

The present invention may be better understood by reading the following detailed description of the preferred embodiment with reference to the accompanying drawings wherein:

FIGS. 2 and 3 together are a detailed circuit diagram of the digital circuitry comprising an oil well pump timer according to the present invention.

DESCRIPTION OF THE PREFERRED EMBODIMENTS

Figure 1:
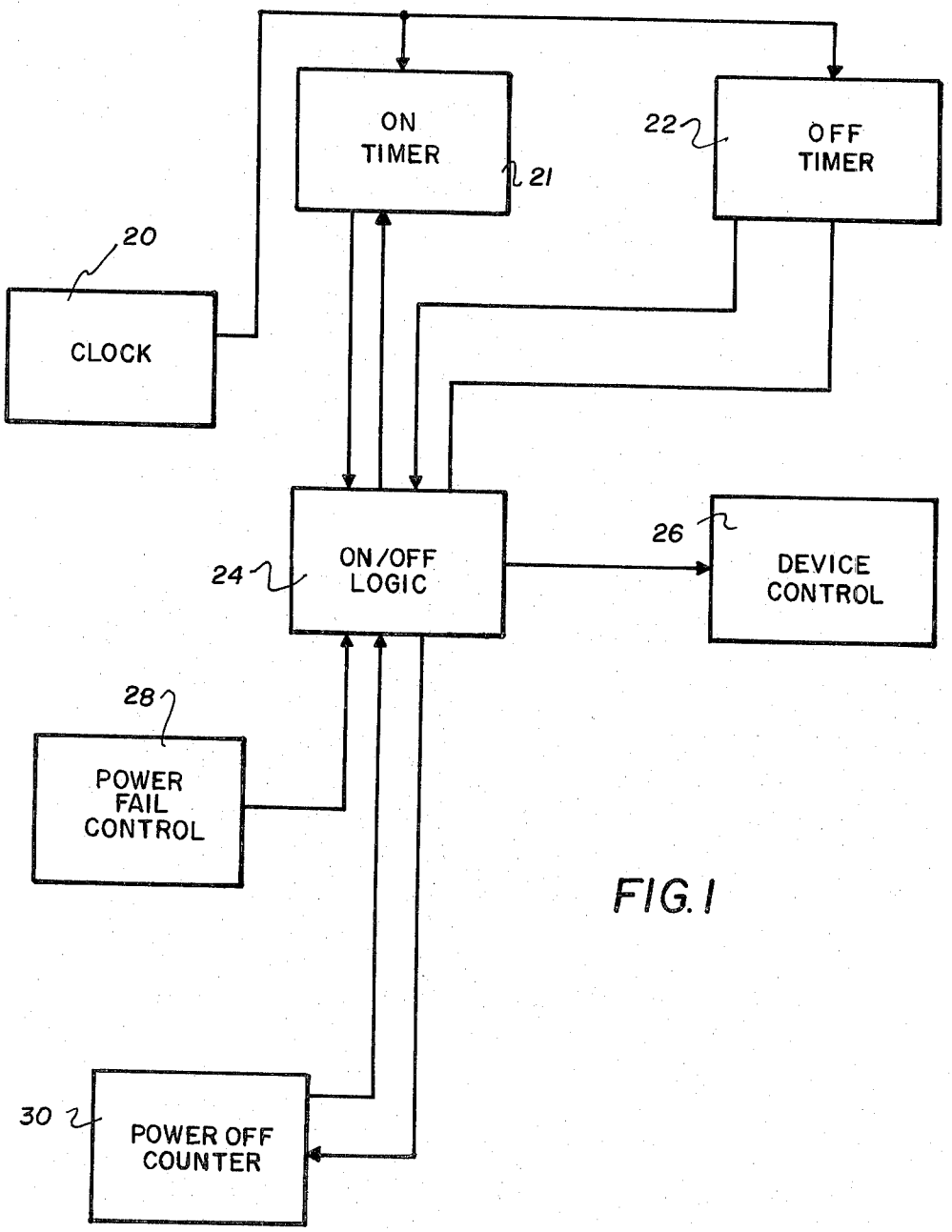
FIG. 1 is a block diagram of a well pump control system according to the present invention.

With reference now to FIG. 1, there is provided a simplified block diagram of an oil well pump time controller according to the present invention. This system is battery operated and does not depend upon the normal AC power system for either operating power or a time base. As a result the system includes an oscillator or clock 20 for providing its own internal time base. The output timing pulses frm clock 20 are coupled to an on timer 21 and an off timer 22. Timers 21 and 22 are preferably presettable with the desired on and off time periods by thumb wheel switches or other means. Output lines from timers 21 and 22 are coupled to on-off logic or control circuitry 24 which performs a number of functions. In normal operation on-off logic 24 causes timers 21 and 22 to alternately count out the preset on time periods and off time periods and provides an output to a device controller 26 to turn on a well pump during the on time periods and turn off the pump during the off time periods. The portion of the system thus far described therefore provides a somewhat conventional on-off duty cycle control for a well pump and allows the operator to preset both the on and off time periods.

A power fail controller 28 includes a detector of power outages and circuitry for modifying the on-off logic 24. During periods of power outages any commands sent by the on-off logic 24 to the device controller 26 are of course meaningless since the pump cannot operate without power. During the power outages the on-off logic under control of the power fail controller 28 sends time signals to a power off counter 30 which counts the signals and thereby keeps track of the total power outage period. In a preferred form the time signals are generated by maintaining on timer 21 in an inactive state while allowing off timer 22 to operate continuously and coupling a pulse to the counter 30 at the end of each off time period. Upon reestablishment of power the power fail controller 28 enables on-off logic 24 to turn on the deivce controller 26 for a time period sufficent to maintain the on time off time ratio, or duty cycle, substantially constant. In the preferred form this is accomplished by having on-off logic 24 deactivate the off timer 22 and allow on timer 21 to run continuously until the number of on time cycles counted out equals the number stored in the power off counter 30. As a result in the preferred form the system insures that for every off time period occuring during the power outage the pump is operated for an on time period after reestablishment of power.

Figure 2:
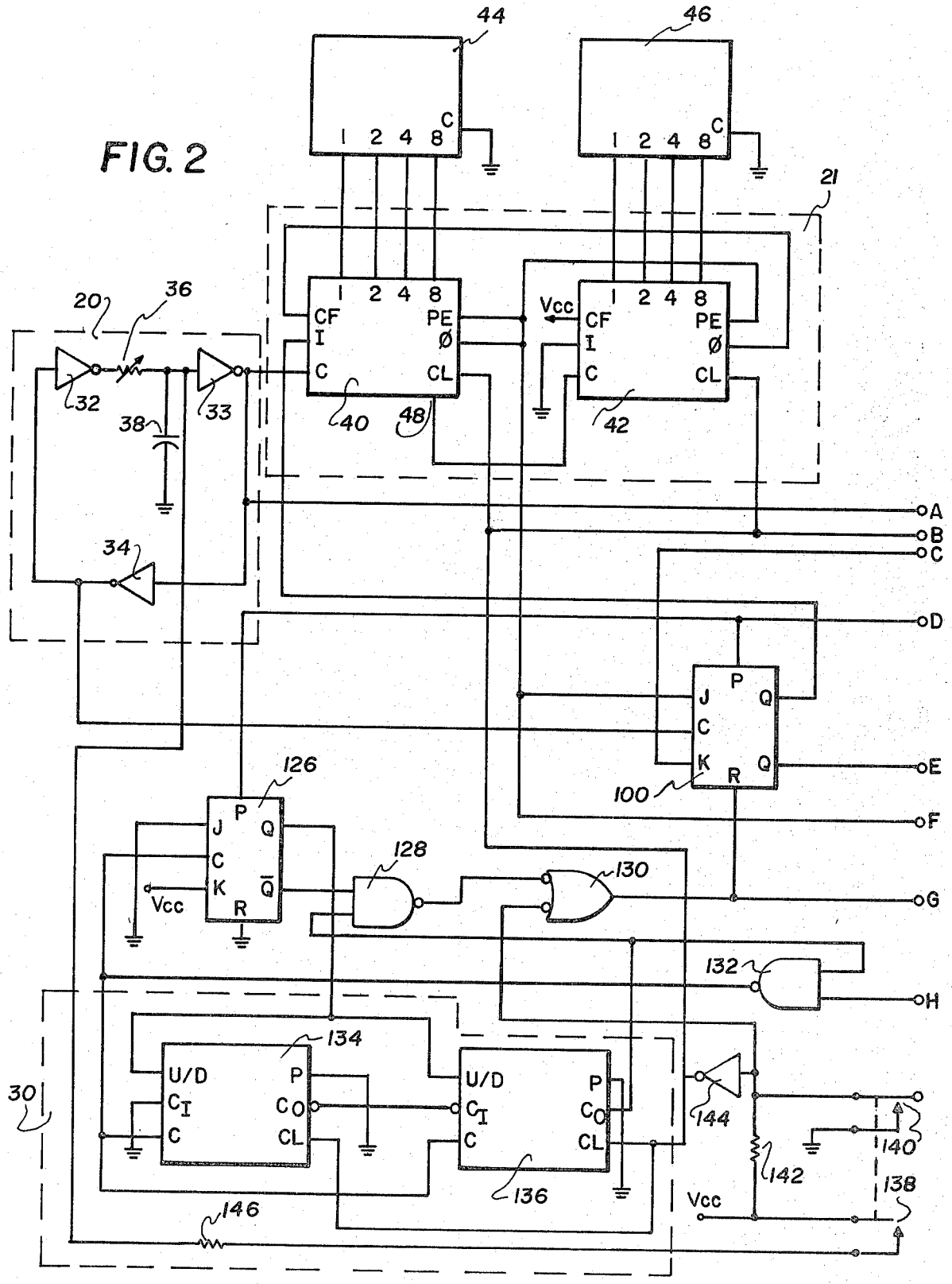

Having now reviewed the basic structure and operation of the system with respect to FIG. 1 reference is now made to FIGS. 2 and 3 for a detailed description of the preferred embodiment. FIGS. 2 and 3 are drawn so that when viewed in side by side relationship, with FIG. 3 to the right of FIG. 2, signal lines which continue from one sheet to the other are in alignment. To aid in alignment of the eight signal lines passing between FIGS. 2 and 3, they are identified by the letters A through H at the points on each figure where they pass to the other. The organization of the various portions of logic circuitry on FIGS. 2 and 3 is also generally the same as that provided in the FIG. 1 block diagram to allow for easier cross reference. For example, in FIG. 2 the dotted line block 20 comprises the time base or clock for the time controller. Clock 20 in the preferred embodiment includes inverters 32, 33 and 34 coupled in a loop with a time delay network comprising a variable resistor 36 and a capacitor 38 positioned between inverters 32 and 33. In this preferred form resistor 36 and capacitor 38 are chosen to provide an oscillator period of one minute. On timer 21 comprises a pair of presettable down counters 40 and 42. Counters 40 and 42 are preferably commercial devices sold under the part number MC 14522 by the Motorola Semiconductor Corporation. Each of the counters 40 and 42 has four preset inputs labeled 1, 2, 4 and 8 which are coupled to a pair of switches 44 and 46 respectively by which the operator can set in a preselected on time period in terms of a number of minutes from one to ninety-nine. In the preferred embodiment each of the preset inputs is provided with a pull-up resistor connected to the positive power supply and switches 44 and 46 ground the appropriate inputs in accordance with the selected time values.

The other connections to down counter 40 are as follows. A "C", clock, input is connected to an output of inverter 33 of clock 20. An "I", inhibit, input is coupled to an output of the on-off logic cell 24 of FIG. 1, the details of which are described further below. A "CF", carry forward, input is coupled to a "0", zero count, output of down counter 42. A "PE," preset enable, input is coupled to the "0", zero count, output of downcounter 40 itself. A "CL," clear, input is coupled to a reset switch arrangement described in more detail below. A final output designated 48 is coupled to the C input of down counter 42.

The remaining connections to other inputs of down counter 42 are as follows. A "CF" input is connected directly to the positive power supply and thereby tied to a logic level one. An "I" input is grounded so that down counter 42 remains uninhibited. A "PE" input is also connected to the "0" output of down counter 40. A "CL" input is connected to the reset circuitry discussed in more detail below. The remaining two inputs of down counter 42 are connected to inputs of down counter 40 as stated above.

The off-timer 22 comprises a pair of down counters 50 and 52 which are preferably identical to down counters 40 and 42 and are interconnected in a very similar manner. For example each of the counters 50 and 52 has four preset inputs designated by the digital values 1, 2, 4, and 8 connected to units and tens switches 54 and 56 respectively. As with the on time counter the switches 54 and 56 allow an operator to set a number from one to ninety-nine in the off time counter 22. In addition, counter 22 includes a third down counting circuit 58 for providing a divide-by-ten function which provides a presettable time period range of ten to nine hundred and ninety minutes. This feature of expanded off time interval is provided since the off time periods are often many times longer than the on time intervals.

The pin connections to down counter 58 are as follows. The preset time input designated by the numeral 4 is permanently grounded and thereby held at a low logic level. The preset input designated 1 is connected to the output of a NAND gate 60 wired in inverter configuration and having inputs connected to a line 62 which is also connected directly to the preset inputs designated 2 and 8. Line 62 is connected to the positive power supply through a resistor 64 and thereby held at a logic one to provide a divide-by-10 function in down counter 58. Line 62 may be grounded by means of a strap designated by the dotted line 66 which causes down counter 58 to change to a divide-by-1 function to reduce the time interval range of offtimer 22. Inputs C and CF are both connected to the output of inverter 33 of clock 20. The "I" input is connected to an output of on-off logic 24, the details of which are explained further below. The "PE" input is connected to the "0" output of down counter 58 itself. Finally the CL input is connected to the reset circuitry.

Remaining connections of downcounter 50 are as follows. The "CF" input is connected to the "0" output of down counter 52. The "I" input is grounded so that down counter 50 remains uninhibited. The "C" input is connected to the "0" output of down counter 58. The "PE" input is connected to the "0" output of down counter 50 itself. The "CL" input is connected to the reset circuitry. And finally, an output 68 is coupled to the C input of down counter 52.

The remaining inputs of down counter 52 are as follows. The "CF" input is connected to the positive power supply and thereby held at logic level 1. The "I" input is grounded to maintain down counter 52 uninhibited. The "PE" input is connected to the "0" output of down counter 50. The "CL" input is connected to the reset circuitry. The remaining inputs are connected to other inputs of down counter 50 as discussed above.

The basic operation of the on and off timers 21 and 22 will now be explained with respect to the off timer 22 to aid in further understanding of the rest of the system. When system operation is begun a reset pulse is supplied to the "CL" inputs. In response to this pulse all counters reset to "0" state and as a result the "0" outputs provide a pulse which is coupled to the "PE" inputs. In response to the signal at the "PE" input, each of the counters presets to the numbers dialed in by the operator in switches 54 and 56. At this point the "0" outputs go low and the counters are ready to begin counting out their preset time intervals. Neither of the counters can begin counting until the inhibit signals are removed. The on-off logic 24 inhibits either of the on-timer or the off-timer thereby allowing only one at a time to function. Thus when the input of down counter 58 goes low, to allow counter 58 to operate, clock signals received on the "C" input cause it to begin down counting. Depending upon the connection of strap 66 down counter 58 provides clock pulses at the same clock period, or one tenth thereof, on its "0" output. Each pulse on the "0" output also presets the counter to the new time period. The "0" output signals from down counter 58 provide the clock input to down counter 50. Down counter 50 begins counting down from its preset level at the rate of received clock pulses. Each time counter 50 counts out it provides a pulse on output 68 coupled to the clock input of down counter 52 to cause the tens down counter 52 to decrement one number. When the tens counter 52 finally counts out completely it provides a pulse on its "0" output line which is coupled to the "CF" input of down counter 50 and allows the "0" output of counter 50 to go high on the next count indicating a total count down of the off-time interval. The on-time counter 21 operates essentially in the same fashion to provide a pulse on the "0" output of down counter 40 at the end of the on time interval. The on and off time interval pulses are used by the remaining circuitry as discussed below.

The device control block 26 of FIG. 1 comprises primarily those elements within the dotted line designated 26 in FIG. 3. A pair of output lines 70 are provided for coupling to the pump motor for turning the motor off and on, assuming of course that power is available. Outputs 70 are connected directly to switch contacts of a latching relay 72 having an on coil 74 and an off coil 76. Each of the coils 74 and 76 is supplied with power from the positive power supply. In addition, a pair of transistors 78 and 80 are coupled to the coils 74 and 76 for driving the coils in response to the logic level signals received from the remaining control circuitry. Transistor 78 in particular is driven by a NAND gate 82 through an invertor 84 thereby providing a simple AND function. In similar manner transistor 80 is driven by the output of a NAND gate 86 coupled through an inverter 88. One input of NAND gate 82 is coupled to the 0 output of down counter 50 to receive the count out pulse indicating the end of an off period which in normal operation sets the relay 72 to the on state and starts the pump motor running. In similar fashion one input of AND gate 86 is coupled directly to the 0 output of down counter 40 to receive the count out pulse indicating the end of an on period and in response reset the relay 72 to an off state to turn the pump motor off. Each of the gates 82 and 86 also receive second inputs from inverters 90 and 92 respectively to inhibit the on and off switching functions during certain operating conditions to be explained further below. An OR function is also provided within this circuitry by means of an OR gate 94 having inverting inputs which receive the outputs from a pair of inverters 96 which are coupled to the count out pulses from both the on-timer and the off-timer to thereby provide both sets of pulses to an output 98 for use by the power fail controller and power off counter as explained below.

The on-off logic circuitry 24 of FIG. 1 basically comprises a flip-flop 100 which provides a function of allowing only the on-timer or off-timer to function at a given time and to alternate therebetween. The connections of the various outputs and inputs of flip-flop 100 are as follows. An "R", reset, input is coupled to the reset circuitry. A "J" input is coupled to the "0" output of down counter 40. A "C", clock, input is coupled to the output of inverter 34 of clock 20. A "K" input is coupled to the "0" output of down counter 50. A "P", input is coupled to an output of the power fail control circuitry 28 of FIG. 1 which is described in more detail below. A "Q" output is coupled to the "I" input of down counter 40 to thereby control the operation of on-timer 21. In similar manner a "$\overline{Q}$" output is coupled to the "I" input of down counter 58 to thereby control the operation of the off-timer 22. The circuitry of FIGS. 2 and 3 thus far described can be seen to be sufficient to control an oil well pump with a presettable fixed duty cycle. Thus, the flip-flop 100, upon receipt of a reset a pulse provides "Q" and "$\overline{Q}$" outputs which allow the on-timer to begin operation but which inhibit the off-timer. As noted above when the reset signal is given off-timer 22 generates a pulse which is coupled to the device controller 26 through gate 82 to turn on a pump motor. Although the on counter 21 generates a similar pulse at the same time, the reset signal is coupled to inverter 92 to thereby inhibit the gate 86 and prevent an off pulse from being simultaneously coupled to coil 76 of latching relay 72. Thus it can be seen that upon application of a reset pulse the system begins operating by turning on the pump and activating the on-timer to count down the preset time period. At the end of the period the on-timer pulse shuts off the pump motor and changes the state of flip-flop 100 so that the off-timer begins counting out the preset off-time period. The on-timer automatically resets itself to its initial state at the end of the on time period so it is ready for the next cycle. The system then continues to operate automatically with alternating on and off time periods as preset by the operator for so long as power is available to the motor. The remaining circuitry is provided for detecting power outages and correcting for lost pumping time after the reestablishment of power.

A portion of the power fail control unit 28 of FIG. 1 includes a power failure indicator contained within the dotted line box 102 in FIG. 3. A battery 104 is also included within this circuitry for providing the positive power supply for the rest of the digital circuitry shown in FIGS. 2 and 3. A full wave bridge rectifier 106 has inputs coupled to a source of AC power derived ultimately from the power source which supplies the well pump motor. In the preferred embodiment, a twelve volt transformer has a primary coupled to the motor supply lines and secondary coupled to inputs 108. The output of rectifier 106 is coupled by a line 110 to a resistor 112 and a diode 114. The resistor 112 is also coupled to the battery 104 to provide a continuous trickle charge to the battery during normal operation so that battery 104 is fully charged to maintain the control system in an operating condition during power outages. The diode 114 couples the rectified current to a smoothing circuit comprising a shunt resistor 116 and series resistor 118 and a shunt capacitor 120. The resulting voltage level on an output line 122 which is coupled to the input of an inverter 124 is a high logic level during normal operating conditions and a low logic level during power outages. Inverter 124 inverts the signal to provide at its output a high logic level only during power outages.

Remaining portions of the power fail control unit 28 of FIG. 1 include a flip-flop 126 and gates 128, 130 and 132. The input-output connections of flip-flop 126 are as follows. The "J" and "R" inputs are both grounded. The "C", clock, input is coupled to the output of NAND gate 132. The "K" input is coupled to $V_{CC}$. The "P" input is coupled to the output of inverter 124 of the power outage detector. The "Q" output is coupled to an up-down control input of power off counter 30 of FIG. 1, the details of which are described below. Finally the "$\overline{Q}$" output is coupled to one input of a NAND gate 128.

The remaining connections of gates 128, 130 and 132 are as follows. A second input of NAND gate 128 and a first input of NAND gate 132 are connected to a zero count output from the power outage counter 30 of FIG. 1. The output of NAND gate 128 is coupled to one input of NAND gate 130 which has a second input coupled to the reset circuitry. The output of NAND gate 130 is coupled to the "R", reset, input of on-off flip-flop 100 and also to the input of inverter 92 to, as discussed above, prevent resetting of the latching relay 72 to an off state when the operator resets the entire system. A second input of NAND gate 132 is coupled to the output line 98 from gate 94 to thereby receive pulses at the end of every on and off period. As noted above, the output of NAND gate 132 is coupled to the clock input of flip-flop 126 and is also coupled to a clock input of the power off counter 30 of FIG. 1.

Power off counter 30 of FIG. 1 comprises a pair of up-down counters 134 and 136 as shown in FIG. 2. These counters are preferably devices sold under the part number MC14516 by the Motorola Semiconductor Corporation. Most of the inputs and outputs of up-down counter 134 and 136 are connected in parallel as follows. The U/D, up-down, inputs are connected to the "Q" output of flip-flop of 126. The "P", preset, inputs are grounded to prevent presetting any values into the counters. The "C", clock, inputs are coupled to the output of NAND gate 132. The "CL", clear, inputs are connected to the reset circuitry. The "CI", carry in, input of counter 134 is grounded so that counter 134 is never inhibited. The "CO", carry out, output of counter 134 is connected to the "CI" input of counter 136 to inhibit counter 136 whenever counter 134 is in the process of counting up or down. The "CO" output of counter 136 is coupled to one input of each of gates 128 and 132.

The only remaining circuitry to be described in FIGS. 2 and 3 is the resetting circuitry shown in FIG. 2. This comprises a pair of normally open switches 138 and 140 which are ganged to operate from a single push button. A first contact of switch 140 is grounded and a second contact is connected through a pull up resistor 142 to the positive power supply. The second contact is also coupled to a second input of gate 130 and through an inverter 144 to the clear inputs of all counters in FIGS. 2 and 3. One contact of switch 138 is connected to the positive power supply and a second contact is connected through a resistor 146 to the input of inverter 33 in clock 20 to stop the clock during resetting and insure that it always starts operating in the same condition.

The operation of the overall time controller as modified to correct for power outages will now be described. Under normal operating conditions with power available, the output of inverter 124 is low so that it has no effect on the states of flip-flops 100 and 126. Upon operation of the reset button flip-flop 100 is reset by the output of NAND gate 130. Also, as noted above, at the time of resetting off-timer 22 provides an output pulse which is coupled to line 98 and through NAND gate 132 to the clock input of flip-flop 126 to thereby reset flip-flop 126 into a normal power on state. Having thus been reset, the system will operate normally as long as power is supplied to the motor. Upon loss of power the output of inverter 124 goes high and this high state is coupled to the "P" inputs of both flip-flops 100 and 126. Both flip-flops are thereby immediately preset to a condition in which the "Q" outputs are both high. As a result the outputs of flip-flop 100 immediately inhibit operation of the on-timer and begin operation of the off timer 22. The "Q" output of flip-flop 126 causes counters 134 and 136 to switch to an upcount condition while the "Q" output is coupled through gates 128 and 130 and inverter 92 to gate 86 to prevent resetting of latching relay 72 to the off condition.

When the up-down counters 134 and 136 are changed to the up count condition the "CO" outputs go to a high logic levle. This output therefore enables gate 132 to couple pulses from line 98 to the clock inputs of counters 134 and 136. During the power outages only the off counter is allowed to operate and each time an off time interval elapses a pulse is generated which is counted by counters 134 and 136. Initially only counter 134 counts the incoming pulses since its "CO" output inhibits counter 136 until such time as counter 134 reaches its upper limit. The pulses after that limit are counted by counter 136. The "CO" output of counter 136 remains in a high logic level state until both counters 134 and 136 are filled which, in the preferred embodiment, would require 255 off time periods. If both counters should become filled, the "CO" output of counter 136 would go to a low logic state and thereby disable gate 134 from coupling any further pulses to the up-down counters.

Upon reestablishment of AC power to the pump motor the output of inverter 124 goes low and thereby removes the preset signals from flip-flops 100 and 126. Upon the occurrence of the next pulse from off timer 22 both flip-flops 100 and 126 are reset and the latching relay 72 is set to an on condition starting the pump motor. The on-timer then begins its down count. When flip-flop 126 is reset, the "$\overline{Q}$" output goes high and this high output together with the high logic level received from the "CO" output of counter 136 provides a low level at the output of gate 128 which in turn provides a high level at the output of gate 130. The output of gate 130 therefore holds flip-flop 100 in a reset condition and is coupled through inverter 92 to gate 86 to prevent pulses from the on-timer from resetting relay 72 to an off state. The pulses from the on-timer are coupled through gate 94 to line 98 and through gate 132 to the up-down counters 134 and 136. The on timer therefore remains activated until it has produced sufficient pulses to count down the counters 134 and 136 to a zero state. Upon occurrence of a low logic level from output "CO" of counter 136 gate 132 is disabled from coupling further pulses to the counters and gate 128 is switched so that it no longer holds flip-flop 100 in a reset condition. From this point on the system returns to normal operation with alternate on and off-time periods having lengths selected by the switch position set in by the operator.

The operation of the system in response to a power failure is basically to store an indication of a duration of the power outage and then upon the reestablishment of power to provide a longer than normal on time interval which is proportional to the period of the power outage. The specific embodiment shown in FIGS. 2 and 3 measures the power outage interval in terms of units equal to the off time interval set in by the operator. A constant duty cycle is quaranteed by providing an on time interval after reestablishment of power which is an integral multiple of the on time interval period set by the operator with the multiplier being equal to the number of off time intervals occuring during the power outage. In this way the system is able to maintain a constant operating duty cycle even though power outages are of random lengths and the operator is free to set in any desired on and off time intervals.

While the present invention has been illustrated and described with respect to particular apparatus it will be apparent that various modification may be made within the scope of the present invention as defined by the appended claims.

We claim:

1. In an oil well pump control system of the type having presettable clock means for cycling a pump through a normal pump sequence of on and off intervals, the improvement comprising:

power outage detection means for generating timing signals in response to the loss of power and restoration of power to the pump;

power outage timing means responsive to said timing signals for generating a control signal representative of the time period of the power loss to the pump; and override means responsive to said control signal for overriding the pump sequence and maintaining the pump on for a period of time having a proportion to the time period of the loss of power to the pump which corresponds to the proportion between said on time interval and said off time interval.

2. Improved oil well pump control apparatus according to claim 1 wherein:

said power outage timing means is coupled to said clock means and includes a counter for counting the number of off-time intervals which occur during said time period of power loss to the pump; and said override means is coupled to said clock means for inhibiting off-time periods after restoration of power to the pump until a number of on-time intervals equal to the number of off-time intervals detected by said counter have occurred.

3. Improved oil well pump control apparatus according to claim 2, wherein said counter is an up/down counter which counts up during said time period of power loss to the pump and counts down after restoration of power to the pump, whereby a zero count indicates that a number of on-time intervals equal to the number of off-time intervals detected by said counter have occurred.

4. Improved oil well pump control apparatus according to claim 1 wherein said clock means includes an oscillator for providing a time base independent of the power supplied to the pump.

5. Improved oil well pump control apparatus according to claim 1 further including a power supply, independent of the power supply to the pump, for powering said oil well pump control system during the time period of the loss of power to the pump.

6. Apparatus for maintaining a predetermined substantially constant on-time to off-time ratio for a time-controlled oil well pump comprising:

on-time means for controlling the on time periods of an oil well pump;

off-time means for controlling the off-time periods of said pump;

power outage detection means for detecting the loss and restoration of power to the pump;

power outage timer means for determining the length of time of a power outage; and on-time modifying means responsive to the restoration of power to the pump and to said power outage timer means for overriding said off-time means and providing an on-time period following the restoration of power to the pump having a length determined as a function of said length of time of said power outage to maintain said predetermined substantially constant on-time to off-time ratio.

7. Apparatus according to claim 6 wherein said power outage timer means includes a counter for counting the number of off-time periods occuring during said power outage, and said on-time modifying means is adapted to override said off-time means following the restoration of power until a number of on-time intervals equal to the number of off-time intervals detected by said counter have occurred.

8. Apparatus according to claim 7 wherein said counter is an up/down counter adapted to count up during said power outage and to count down after restoration of power, whereby a zero count indicates that a number of on-time intervals equal to the number of off-time intervals detected by said counter have occurred.

9. Apparatus according to claim 6 further including an oscillator independent of power supplied to the oil well pump, having an output for providing a time base to said apparatus.

10. Apparatus according to claim 6 further including a power supply, independent of the power supplied to the oil well pump, for powering said apparatus during a power outage.

* * * * *